US005772318A

United States Patent [19]

Vadnais

[11] Patent Number: 5,772,318

[45] Date of Patent: Jun. 30, 1998

[54] PORTABLE HAND-HELD CONCRETE AND MORTAR MIXER

[76] Inventor: Kenneth Vadnais, 28995 Sunnydale, Livonia, Mich. 48152

[21] Appl. No.: 412,080

[22] Filed: Mar. 28, 1995

Related U.S. Application Data

[63] Continuation-in-part of Ser. No. 147,978, Nov. 5, 1993, Pat. No. 5,401,098.

[51] Int. Cl.[6] ..... B28C 5/08

[52] U.S. Cl. ..... 366/64; 366/129

[58] Field of Search ..... 366/64, 65, 61, 366/129–130, 293, 279, 348, 349, 66; 416/195; 172/557, 604, 42, 43, 57, 60, 119, 123

[56] References Cited

U.S. PATENT DOCUMENTS

| | | | |
|---|---|---|---|
| 994,978 | 6/1911 | Clemens | 366/65 |
| 1,593,706 | 7/1926 | Skoog | 172/42 |
| 2,624,905 | 1/1953 | Howard | 172/43 |
| 2,792,900 | 5/1957 | Howard | 172/43 |
| 2,989,127 | 6/1961 | Oertle | 172/43 |
| 3,031,018 | 4/1962 | Smithers | 259/135 |
| 3,166,303 | 1/1965 | Chapman | 259/135 |
| 3,185,451 | 5/1965 | Snyder | 259/179 |
| 4,074,764 | 2/1978 | Enters | 172/42 |
| 4,077,477 | 3/1978 | Vander Lely | 172/43 |
| 4,256,183 | 3/1981 | Hanely | 172/123 |
| 4,761,076 | 8/1988 | Witcombe | 366/46 |

*Primary Examiner*—Charles E. Cooley
*Attorney, Agent, or Firm*—James M. Deimen

[57] ABSTRACT

A portable hand-held concrete, mortar and gypsum mixer comprises a small gasoline powered implement having a drive shaft extending generally downward from the handles to a gear box. A transverse shaft driven by the drive shaft extends to either side of the gear box. Mounted on the transverse shaft are a plurality of blades shaped to thoroughly agitate and mix a combination of water and the ingredients for concrete, mortar, gypsum or similar heavy, hard to mix materials. Surrounding the blades are thin rings attached to the blades to form a round circumferential surface about the blades and thereby prevent the blades from directly contacting the mixing trough or other means of containing the mix. In the alternative, the plurality of blades may be shaped at their peripheries to form substantially continuous circular circumferences. Further improvements to the hand-held mixer comprise a positionable handle to easily control the mixer from the side, a flexible extension extending from the drag bar for more speed control by the user by manually changing the vertical orientation of the mixer handles, and openings through the mixing blades to more thoroughly mix the material by transverse movement of the material through the openings in the blades.

11 Claims, 3 Drawing Sheets

PORTABLE HAND-HELD CONCRETE AND MORTAR MIXER

This application is a continuation-in-part application of my co-pending patent application U.S. Ser. No. 08/147,978, filed Nov. 5, 1993, now issued as U.S. Pat. No. 5,401,098 on Mar. 28, 1995.

Background Of The Invention

The field of the invention pertains to light-weight portable mixers and, in particular, to hand-held powered mixers for thick heavy viscous liquids which may contain solids.

Typically, concrete, cement mortar, gypsum and other similar construction materials are mixed in stationary, truck or trailer mounted rotary bowls. The bowls are equipped with curved fins inside to assist in thoroughly mixing water with the powder and aggregates. Even the smallest bowl mixers are too heavy for one person to easily lift because of the weight of the steel bowl and attached motor. When a relatively small amount is needed these construction materials are typically hand mixed with a perforated hoe in a metal trough.

Despite the need for a truly portable powered hand-held mixer, apparently none are commercially available. An early apparently portable mixer is disclosed in U.S. Pat. No. 994,978. This mixer has an externally driven shaft with a plurality of curved mixing blades thereon. The material is mixed as the blades move the material parallel to the shaft to the outlet.

U.S. Pat. No. 3,166,303 discloses a plurality of blades on a vertical shaft as the mixing device. The shaft is powered by a portable electric drill and a vertical barrel is used to contain the mix. U.S. Pat. No. 3,185,451 also discloses an electric powered hand-held mixer having a pair of counter-rotating spiral wire blades. The mixer is used in a large mixing trough.

U.S. Pat. No. 4,761,076 and an advertising brochure from Sears, Roebuck & Co., Chicago, Ill. disclose a wheeled mixing tub equipped with an auger mixer. The auger is gasoline powered and mounted permanently to the tub in a manner that permits the auger to be moved from one side of the tub to the other. Thus, the mixer is not truly portable in the manner of a hand-held mixing device.

SUMMARY OF THE INVENTION

It is an object of the invention to provide a sufficiently powerful hand-held mixer than can quickly and efficiently mix concrete, mortar and gypsum in small quantities.

It is a further object of the invention to provide a mixer that is as light, portable and simple to operate as other common power tools and power yard implements intended for the home handy-man or woman.

It is also an object of the invention to provide a powerful hand held-mixer to mix concrete, the mixer being easy to position and control by the user whether the user is behind or to a side of the mixer.

It is a further object of the invention to provide sufficient transverse flow of the material being mixed to achieve quick and effective mixing thereof.

It is a further object of the invention to provide a control device on the mixer to effect a speed change of the travel of the mixer through the material desired to be mixed.

The new mixer is based upon a small hand-held gasoline powered garden tiller such as the Ryobi Cultivator Model 410r from Ryobi Outdoor Products, Inc., Chandler, Ariz.

The blade assembly is modified by adding circular steel rings having a diameter slightly greater than the maximum diameter swept by the tiller blades. The steel rings are formed of rod and brazed or welded to the tips of the tiller blades. Additional steel rod spokes attach the rings to the blade hubs. The rings permit the hand-held tiller to be operated in a mixing trough without damage to the trough or the blades of the tiller.

The mixer is particularly effective and convenient. The prototype mixer weighs about twenty-five pounds and mixes thoroughly a one-hundred pound bag of ready-mix concrete or mortar with water in less than three minutes. Although described in terms of steel blades and rings, the mixing blade assemblies can be constructed of other metals or engineered plastics. With engineered plastics, inadvertent impacts are less likely to dent the blade assemblies or damage a container.

DESCRIPTION OF THE PREFERRED EMBODIMENT

Figure 1:
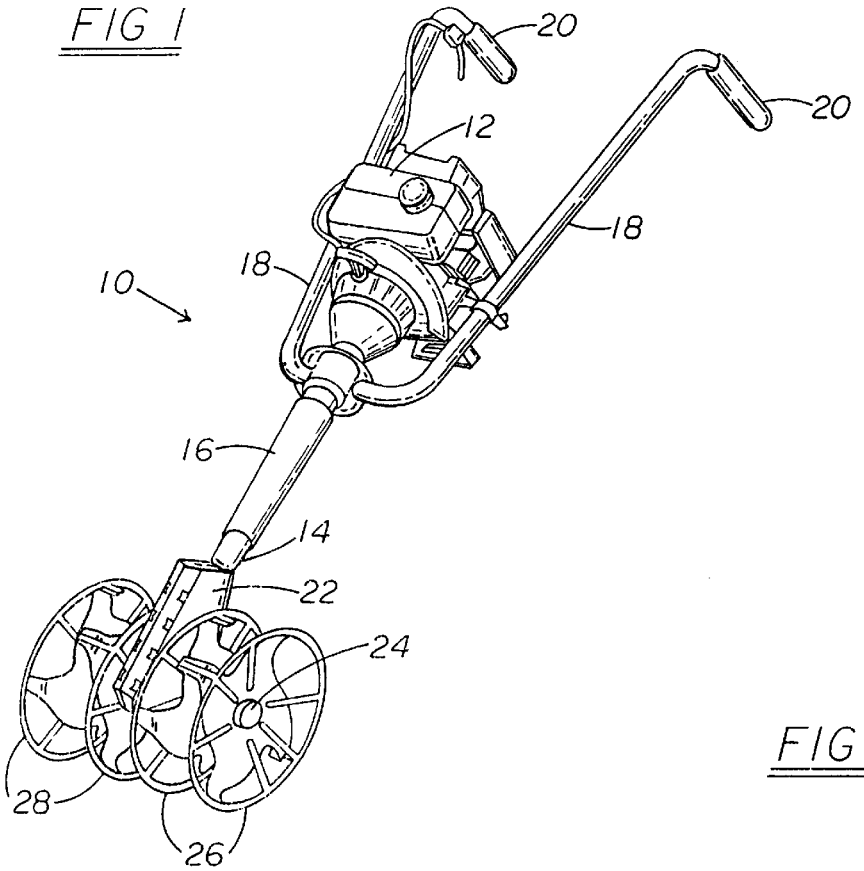
FIG. 1 is a perspective view of the new mixer.

Illustrated in FIG. 1 is a small hand-held tiller generally denoted by 10 that is modified into a mixer. The tiller 10 includes a small gasoline engine 12 mounted on a drive shaft housing 14 that in turn is covered with a hand grip 16. Attached to the drive shaft housing 14 is a pair of handles 18 also with hand grips 20. At the lower end of the drive shaft housing 14 is a gear box 22. Located within the drive shaft housing 14 is a drive shaft connected to the engine 12 and extending into the gear box 22. Extending horizontally from the gear box 22 is a shaft 24 upon which are mounted two pairs of blade assemblies 26 and 28 to either side of the gear box 22.

Figure 2:
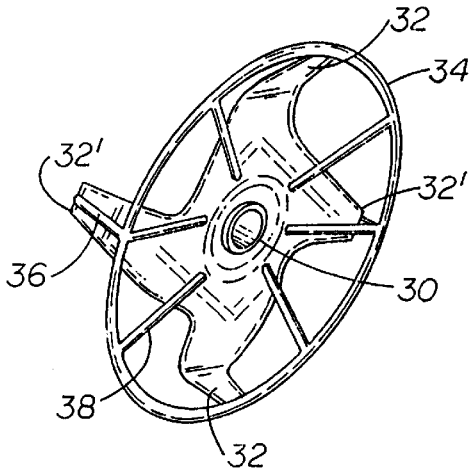
FIG. 2 is a close-up perspective view of one of the blade assemblies for the mixer.

Referring to FIG. 2 each blade assembly 26 or 28 comprises a disc and hub 30 for mounting on the shaft 24 and four tines 32 and $\mathbf{32}^1$ that are bent over from the disc in the same manner as tiller tines. A steel ring 34 is welded or brazed to the tips of the two diametrically opposite tines 32 that extend in the same direction. The two alternating diametrically opposite tines $\mathbf{32}^1$ extend in the opposite direction and are connected to the ring 34 by short transverse pieces 36 of rod welded therebetween. In addition, a plurality of short radial rods 38 extend from the disc and hub 30 area to the ring 34 to form spokes welded or brazed therebetween. The entire blade assembly forms a rigid "cage" that both protects the tines 32 from impact with the container of the material to be mixed and assists in mixing the material.

Figure 3:
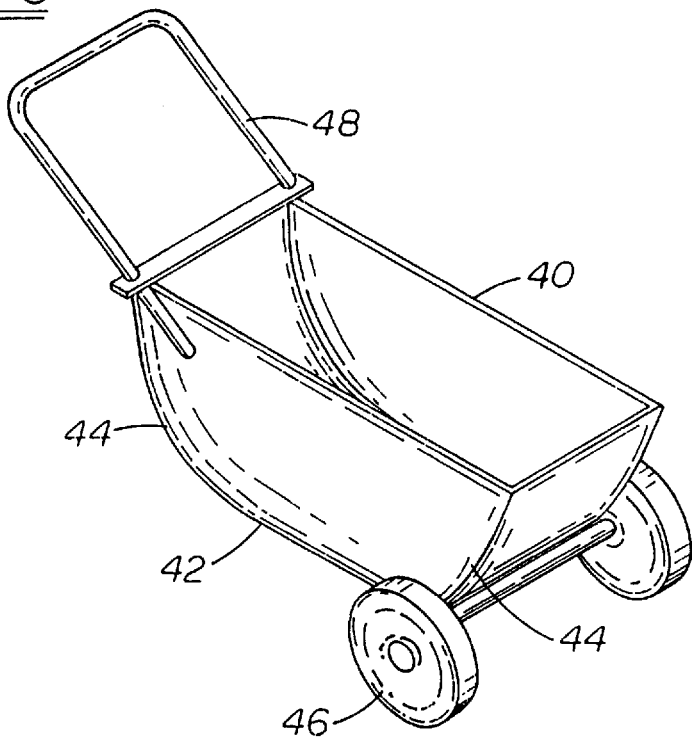
FIG. 3 is a perspective of a small separate mixing trough that is particularly effective with the mixer.

Although the new mixer may be used with any large conventional concrete and mortar hand mixing trough or container of sufficient size, a particularly convenient mixing trough 40 is shown in FIG. 3. The trough is sized to a width about one inch greater than the full blade width of the new mixer. The trough is also about three feet long and one foot deep. The bottom 42 of the trough 40 is curved upward at the ends 44 to eliminate bottom corners that otherwise would collect unmixed or ineffectively mixed material. The trough 40 also includes a set of wheels 46 at one end and a handle 48 at the other end. A single eighty or one-hundred pound bag of ready-mix concrete or mortar can be quickly mixed with water using the mixer. The trough 40 can then be easily wheeled to the desired location and dumped by raising the handle.

Cleaning of the mixer and trough are also greatly simplified in comparison with conventional concrete and mortar mixers. The trough is merely filled with fresh water and the mixer operated in the water in the trough. The vigorous mixing action quickly and effectively cleans both mixer and trough.

As alternative forms of the mixer an electric motor may be substituted for the small gasoline engine. The blades may also be modified in shape to have external peripheries substantially circular in circumference. The substantially circular peripheries protect the blades and container from impact damage in substitution for the rings.

Figure 4:
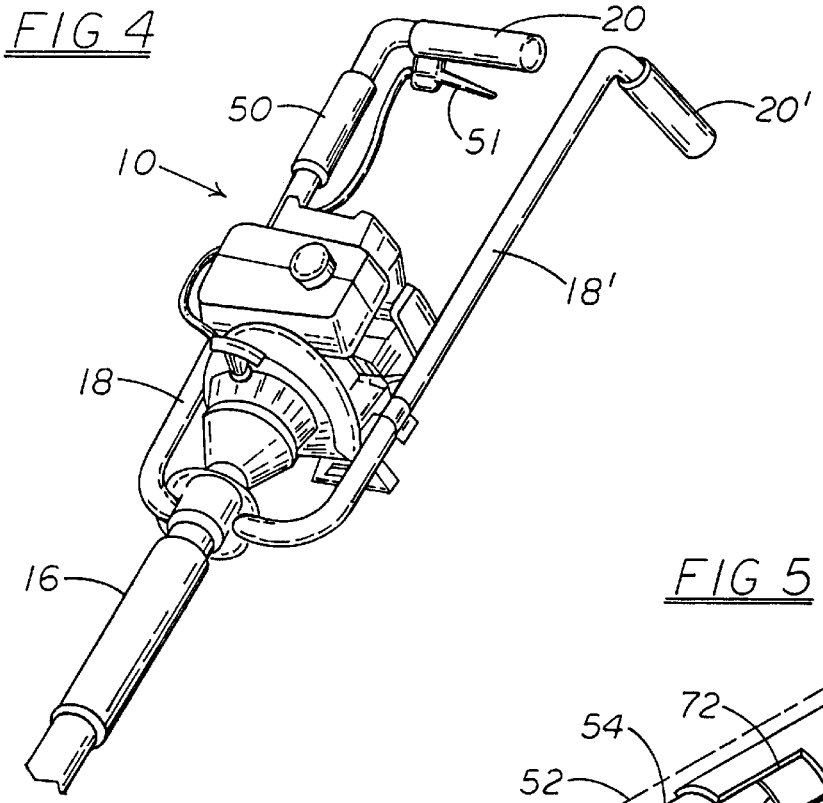
FIG. 4 is a perspective view of the top of the mixer having a movable handle.

Illustrated in FIG. 4 is an improvement to one of the pair of handles 18 with hand grips 20. One of the handles 18 has means for moving and positioning the handle 18 relative to the other handle 18' and grip 20', the means for moving and positioning denoted as 50.

Figure 5:
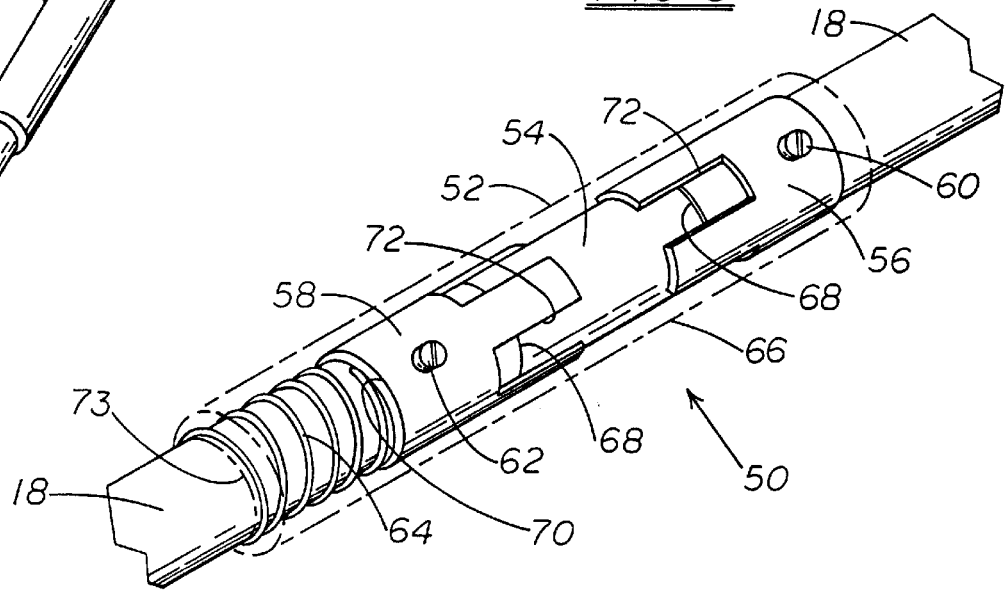
FIG. 5 is an exploded perspective view of the movable handle illustrating the assembly thereof.

FIG. 5 clearly shows the means for moving and positioning generally denoted as 50 as an adjustment device 52. The handle 18 is severed at 68 and the adjustment device 52 is then located onto the handle 18. The adjustment device 52 comprises a slip fit tube 54 to join the severed ends of the handle 18, an upper coupling 56, a lower coupling 58, and means 60 such as a screw for attaching the upper coupling 56 and tube 54 to the handle 18. The lower coupling 58 is attached to the handle 18 with a second screw 62. Screw 62 only engages the handle 18. Means for biasing 64 the lower coupling 58 to the upper coupling 56 such as a spring, engage the lower edge 70 of the coupling 58. A housing 66 (shown in phantom) covers the adjustment device 52 and is also retained by screw 60 to handle 18. Screw 62 is hidden beneath the housing 66.

The means for biasing 64 the lower coupling is here shown as a spring but other biasing means such as resilient bands could be advantageously employed. The couplings have castellated joining surfaces 72 that interengage, thereby retaining the upper and lower coupling 56, 58 in a joined configuration until they are selectively disjoined as shown. The spring 64 is trapped between the lower edge 70 of the coupling 58 and a bottom edge 73 of housing 66 which extends slightly inward into close proximity with handle 18.

It is to be understood that although shown on one handle 18, one or more handles could advantageously employ the means for moving and positioning 50. Referring back to FIG. 4 it may be noted that the handle adjustment means 50 requires that the housing 66 and a portion of the mixer below the adjustment means must be simultaneously gripped to extend and rotatably reposition the grip 20 and handle 18. Thus, the user must release the throttle lever 51 to reposition the grip 20. Preferably, the user grasps the hand grip 16 and the housing 66 to extend and reposition. If the user attempts to reposition by grasping the grip 20, the offset from the axis of the adjustment 50 causes slip fit tube 54 to bind within handle 18.

Thus, by employing the above, at least one of the handles 18 can be rotated by 90 degrees or another angle depending on the number of castellations employed. This rotation allows the user to stand beside the mixer 10 and exert greater control over it by grasping grip 20 and hand grip 16 in the manner of a shovel. This control feature is particularly useful while the mixer 10 is moving through material in a trough because the user does not need to stretch from one end to reach the other end of a long trough while operating the mixer. Nor does the user now need to strain awkwardly across the mixer 10 to hold the handles in a non-ergonomic grasp. The mixer is as easy to move as a grain or snow shovel and therefore can easily be used to mix in a wheelbarrow.

Figure 6:
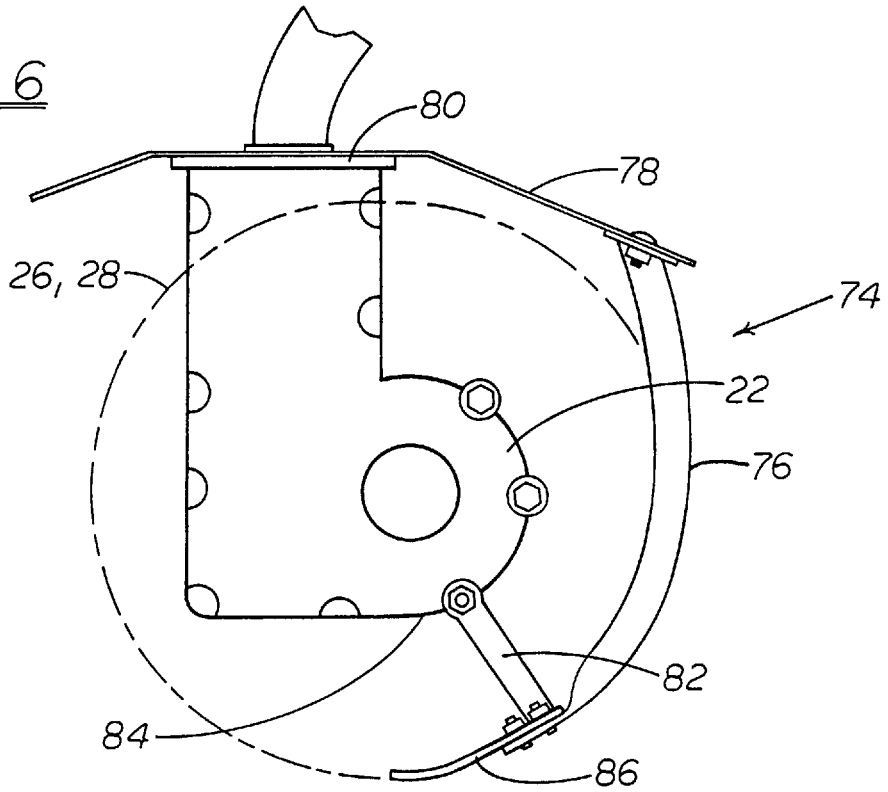
FIG. 6 illustrates a partial view of the bottom of the mixer from the side showing a flexible extension affixed to the drag bar.

Now turning to FIG. 6, a mixing drag bar generally denoted as 74 is shown at the back of the mixer 10. A normal drag bar on a rototiller is made from narrow flat metal bar stock that must be manually adjusted and extends beyond the sweep of the rotating tines. In contrast, the mixing bar 74 of the invention comprises a tube 76 extending from a shroud 78 emplaced across the top 80 of the gear box 22 of the mixer 10. The tube 76 attaches to the center of the shroud 78 and curves behind the gear box 22. The tube 76 curves with substantially the same radius as the blade assemblies 26, 28. The drag bar 76 is tubular to prevent material from clogging between the gear box 22 and drag bar. The tube 76 is stabilized by attaching it by a bracket 82 to a corner of the bottom 84 of the gear box 22.

An extension tip 86 about two inches long and one inch wide is attached to and extends from the tube 76. The extension tip 86 may be curved to follow the substantially circular periphery as with the mixing drag bar 74 or extend somewhat tangentially from the circular periphery. The extension tip 86 extends approximately directly beneath the gear box 22 and can be formed from plastic material as it is desirable that the extension tip 86 be flexible. The flexibility allows the extension tip 86 to conform to the bottom of the trough in which the mixer is used. The extension tip 86 thus self adjusts and scrapes cleanly but does not gouge the bottom of the trough. The extension tip 86 also spreads the material from under the gear box 22 and holds the mixer down in the material to avoid leaving any material in the bottom of the trough as it is being mixed. In contrast, if a solid stiff extension was substituted, the extension would tend to gouge the bottom of the trough instead of conforming to it. This contact eventually would gouge out parts of the trough particularly if the trough were formed from wood or plastic.

The forward motion of the mixer 10 is controlled by the tilt that the user of the mixer provides to the handles. The user can cause the mixer to move faster through the material by moving the handles in a downwardly and backwardly orientation because the flexible extension tip 86 becomes horizontal against the bottom of the trough creating less resistance to forward motion. The material forced over the flexible plastic extension tip 86 pushes the tip down keeping it firmly on the bottom of the trough and controls the forward pull of the mixer, keeping the mixer from running up and out of the material.

An opposite effect is achieved when the user moves the handles in an upwardly and forwardly orientation; namely, the forward motion of the mixer is slower through the material to be mixed. As the extension tip 86 moves out of a horizontal position on the bottom of the trough it impedes the flow of the material thereby slowing the forward motion of the mixer 10. The weight of the mixer 10 itself and a vertical orientation of the mixer causes the mixer to move downwardly when it is introduced into the material to be mixed in the trough. Therefore, the user's positioning of the handles effectively controls the speed of travel of the mixer through the material. The flexible extension tip 86 is envisioned to be fabricated from different widths and flexibilities of flexible material to suit various mixing needs.

The control of the motion of the mixer 10 is facilitated by the open wheels or cages of the blade assemblies 26, 28. The open wheels or cages allow the material being mixed to flow easily transversely through the blade assemblies 26, 28 whatever the tilt that the user has imparted to the mixer 10 through the handles 18. The transverse flow of the material helps to quickly and effectively mix the material.

As the mixer is used, the user can push the handles downwardly or upwardly thereby angularly moving the extension tip 86 in the material to be mixed. This has the effect of either speeding or slowing the progress of the mixer through the material because the extension tip is moved in its position in the material. By downwardly and backwardly deflecting the handles, the extension tip 86 angles for a better flow of the material. Conversely, if the handles are pulled upwardly and forwardly, the extension tip 86 moves thereby slowing the material flow. The extension tip 86 is shown in a basically horizontal position in FIG. 6.

I claim:

1. A portable hand-held mixer comprising handle means having a plurality of handles to support the mixer in a generally upright position, an engine, drive means extending generally downwardly from the engine, the drive means being attached to the handle means, a lower end on the drive means, a transverse shaft in engagement with the drive means at the lower end and extending outwardly from the lower end, a plurality of mixing blades mounted on the transverse shaft, the plurality of mixing blades having openings therethrough for transverse movement of material being mixed, at least one of the mixing blades having a contiguous periphery forming a full circle, all portions of said at least one mixing blade limited radially and outwardly transversely by the contiguous circular periphery, and means for moving and re-positioning at least one of said handles relative to the mixer.

2. The portable hand-held mixer according to claim 1 wherein the means for moving and re-positioning at least one of said handles is selectably re-positionable at 0 and 90 degrees to another of the plurality of handles.

3. The portable hand-held mixer according to claim 1 wherein the means for moving and re-positioning at least one of said handles comprises an adjustment device on the handle, the adjustment device comprising positionably interengageable couplings.

4. The portable hand-held mixer according to claim 1 further comprising a mixing drag bar placed within the contiguous circular periphery, said mixing drag bar attached to the lower end of the drive means, and an extension tip extending from the mixing drag bar.

5. The portable hand-held mixer according to claim 4 wherein the extension tip comprises plastic.

6. The portable hand-held mixer according to claim 4 wherein the extension tip is flexible and extends somewhat tangentially from the contiguous circular periphery.

7. A portable hand-held concrete and mortar mixer comprising a plurality of mixing blades rotatable about at least one axis, means to rotate the mixing blades and a pair of handles to support the mixer in a generally upright position, handle means for selectably repositioning at least one handle at 0 or 90 degrees relative to the other handle and said handle means having a plurality of selectably adjustable positions relative to the at least one axis of the plurality of mixing blades on the mixer.

8. A portable hand-held mixer comprising handle means having a plurality of handles to support the mixer in a generally upright position, an engine, drive means extending generally downwardly from the engine, the drive means being attached to the handle means, a lower end on the drive means, a transverse shaft in engagement with the drive means at the lower end and extending outwardly from the lower end, a plurality of mixing blades mounted on the transverse shaft, the plurality of mixing blades having openings therethrough, at least one of the mixing blades having a periphery substantially forming a full circle, all portions of said at least one mixing blade limited radially and outwardly transversely by the substantially circular periphery, a drag bar attached to the mixer and an extension tip projecting from the drag bar for assisting in transverse movement of material being mixed.

9. The portable hand-held mixer of claim 8 wherein the extension tip is flexible and extends somewhat tangentially from a radius about equal to the radius of the substantially circular periphery.

10. A portable hand-held mixer comprising handle means having a plurality of handles to support the mixer in a generally upright position, an engine, drive means extending generally downwardly from the engine, the drive means being attached to the handle means, a lower end on the drive means, a transverse shaft in engagement with the drive means at the lower end and extending outwardly from the lower end, a plurality of mixing blades mounted on the transverse shaft, the plurality of mixing blades having openings therethrough, at least one of the mixing blades having a periphery substantially forming a full circle, all portions of the at least one mixing blade limited radially and outwardly transversely by the substantially circular periphery, a drag bar attached to the mixer, an extension tip projecting from the drag bar, and the handle means having means for moving and positioning at least one of said handles relative to the mixer.

11. A portable hand-held concrete and mortar mixer comprising a plurality of mixing blades rotatable about at least one axis, means to rotate the mixing blades and a pair of handles to support the mixer in a generally upright position, handle means for selectably repositioning at least one handle parallel to the at least one axis of the plurality of mixing blades on the mixer, and said handle means having a plurality of selectably adjustable positions relative to the at least one axis of the plurality of mixing blades on the mixer.

* * * * *